United States Patent [19]

Bardonnet et al.

[11] 4,176,501

[45] Dec. 4, 1979

[54] DEVICE FOR ATTACHING ON A SPECTACLE LENS A BLOCK FOR MOUNTING ON AN EDGING OR BEVELLING MACHINE

[75] Inventors: Pierre Bardonnet, Montgeron; Jean-Rene Chamberaud, L'Isle Adan, both of France

[73] Assignee: Essilor International (Compagnie Generale d'Optique), Joinville le Pont, France

[21] Appl. No.: 886,635

[22] Filed: Mar. 15, 1978

[30] Foreign Application Priority Data

Mar. 25, 1977 [FR] France ..... 77 08951

[51] Int. Cl.[2] ..... B24B 19/00; B24B 13/00

[52] U.S. Cl. ..... 51/277

[58] Field of Search ..... 51/277, 216 LP, 284

[56] References Cited

U.S. PATENT DOCUMENTS

| | | | |
|---|---|---|---|
| 2,603,922 | 7/1952 | McCarthy et al. | 51/277 |
| 3,333,369 | 8/1967 | Barr | 51/277 |
| 3,962,833 | 6/1976 | Johnson | 51/216 LP |

*Primary Examiner*—James L. Jones, Jr.
*Assistant Examiner*—Roscoe V. Parker, Jr.
*Attorney, Agent, or Firm*—Burgess, Ryan and Wayne

[57] ABSTRACT

A device for attaching on a spectacle lens a block for mounting on a lens edging or bevelling machine comprises fixed mounting block holding means, lens holding means located substantially in one plane and movable between a rest or centering position, in which the lens to be blocked is at a distance from the mounting block and a blocking position for securing the mounting block on the lens. This device further comprises centering marks located substantially in the plane formed by the lens holding means when no lens is placed on said holding means. The centering marks are movable in a direction substantially perpendicular to said plane in such a way that they are always in contact with the surface of a lens placed on its holding means, said surface being the surface adapted to receive subsequently the mounting block.

5 Claims, 3 Drawing Figures

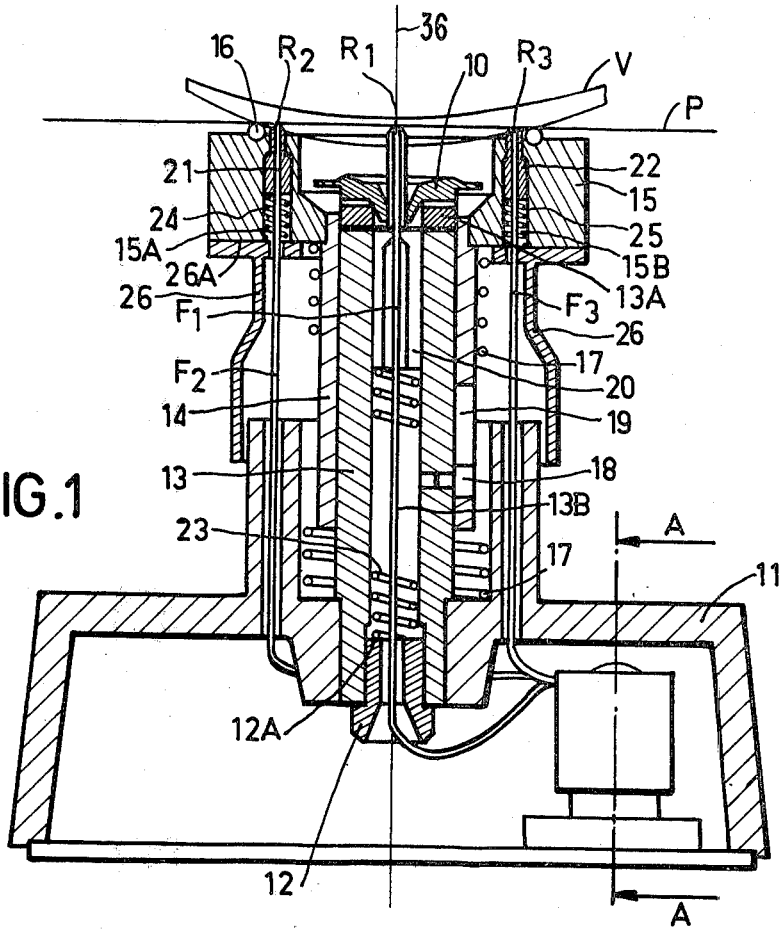
FIG.1
FIG.2
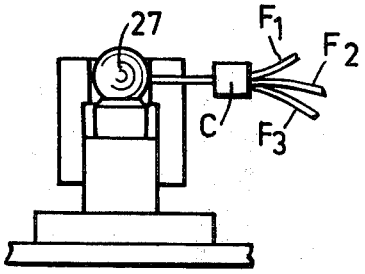
FIG.3
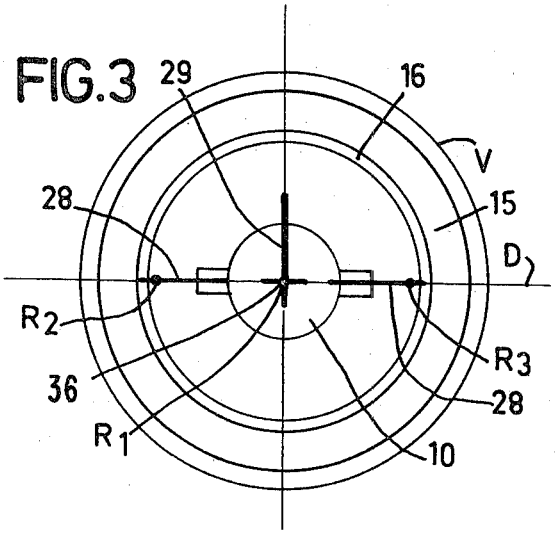

DEVICE FOR ATTACHING ON A SPECTACLE LENS A BLOCK FOR MOUNTING ON AN EDGING OR BEVELLING MACHINE

BACKGROUND OF THE INVENTION

The present invention is directed to a device for fixing, on a spectacle lens, a mounting block for mounting the lens on the lens holder of an edging or bevelling machine.

Said mounting block can be, for example, the block described in French Patent application No. 76 14 905, filed on May 18th 1976, in the name of the applicant, or a similar block, flexible or rigid, adapted to be engaged on a spindle of an edging or bevelling machine.

The known blocks are provided on their blocking surface with an adhesive coating for fixing them onto the spectacle lenses and on the opposite surface with orienting and driving means adapted to cooperate with the complementary means of the spindle of the edging or bevelling machine.

An Apparatus, commercially available from the 3 M Company under the name of "3 M Brand EAP Blocker" enables such mounting blocks to be affixed to spectacle lenses.

This known apparatus is provided with fixed means for holding and positioning the mounting block, said means being similar to those of the spindle of the edging or bevelling machine.

The apparatus is further provided with fixed luminous marks for correctly positioning the lens, opposite to the block, before placing the block on the lens. Centering marks adapted to be put into coincidence with those of the apparatus are previously marked on the lens, generally on its convex surface onto which the block will be fixed.

The operator holds the lens between his fingers, above the mounting block, positions and orients it properly in relation to the luminous marks, then applies the lens onto the block. It is difficult to carry out these operations because the operator has no support for the lens, which frequently causes significant centering errors.

Another apparatus is also known, which is used only for fixing a suction cup onto a lens. It is provided with a fixed suction cup holder and a movable lens having centering marks consisting of engraved lines.

The marks on the lens are made to coincide with those on the holder, then while maintaining the lens correctly on its holder; pressure is applied on the assembly in order to fix the suction cup on the lens. The apparatus is more convenient than the one previously described; however both present the same major drawback: the centering marks, luminous marks or engraved lines are fixed and placed in a single common plane.

The marks on the lens are disposed on one of its surfaces and are at a distance from the plane of the marks on the apparatus, said distance being more or less large according to the curvature of the marked surface of the lens. This can result in significant parallax errors and therefore in a defective positioning of the mounting block on the lens.

BRIEF SUMMARY OF THE INVENTION

The device according to the invention, which is simple and economical and allows this major drawback to be overcome, comprises centering marks which are movable in such a way as to be always in contact with the lens surface which bears the marks and on which the mounting block has to be fixed, whatever the curvature of said lens surface may be.

The device according to the invention is provided with a fixed mounting block holding means, lens holding means located substantially in one plane and movable between a rest or centering position in which the lens to be blocked is at a distance from the mounting block, and a blocking position for securing the mounting block on the lens, as well as centering marks, located substantially in the plane of the lens holding means when no lens is placed on said holding means, said centering marks being movable in a direction substantially perpendicular to said plane in such a way as to always be in contact with the surface of a lens placed on its holding means, said surface being that which has to subsequently receive the mounting block.

BRIEF DESCRIPTION OF THE DRAWING

The invention will be described in a more detailed manner herein below with reference to the appended drawings which are by way of illustration and not of limitation.

FIG. 1 is a sectional view of the device according to the invention.

FIG. 2 is a sectional view, showing a sub-assembly, of the device according to the invention.

FIG. 3 shows how a spectacle lens is centered using the device according to the invention.

DESCRIPTION OF THE PREFERRED EMBODIMENTS

The mounting block adapted to be attached to the lens V is designated by reference numeral 10.

The device comprises a base 11 onto which is fixed by means of a nut 12, the holder 13 of the mounting block 10.

The upper part 13A of the holder 13 is provided, for positioning and maintaining the mounting block 10, with means which are complementary to means for positioning and maintaining the block on an edging or bevelling machine.

The outer surface of the holder 13 is cylindrical and the lens holding means is slidably mounted on it.

The lens holding means comprises a hollow cylinder 14, on which the lens holder 15 is fixed.

At the upper part of the holder 15, an o-ring 16 is attached, which defines the plane P of the lens holding means, said plane P being tangent to ring 16.

The lens holding means 14, 15 and 16 are maintained in a rest position, called centering position, by a spring 17 which is supported by a face of the base 11 and by the lower face of holder 15.

A pin 18, mounted in holder 13 and engaging a groove 19 of hollow cylinder 14, provides a translational guiding of the lens holding means on holder 13. In the rest position of the lens holding means the end of groove 19 engages pin 18. Pin 18 may be cylindrical, square or rectangular.

The centering marks $R_1$, $R_2$ and $R_3$ are substantially located in plane P, when no lens is placed on o-ring 16. These centering marks $R_1$, $R_2$ and $R_3$ may comprise colored pellets of fluorescent or non-fluorescent material, carried by suitable supports. In the preferred embodiment, marks $R_1$, $R_2$ and $R_3$ comprise the luminous ends of optical fibers, $F_1$, $F_2$ and $F_3$ respectively, optical fibers made of glass or plastic material. Fibers $F_1$, $F_2$ and $F_3$ are fixed in holders 20, 21 and 22 respectively, which are movable in a direction substantially perpendicular to plane P. Holders 20, 21 and 22 are maintained in abutment in their respective recesses by springs 23, 24 and 25.

Holder 20 is slidably movable against the force of spring 23 located in a recess 13B provided to this end within holder 13.

Holders 21 and 22 are slidably movable against the force of springs 24 and 25 located in recesses 15A and 15B in holder 15. The lower end of spring 23 rests on the face of 12A nut 12.

Springs 24 and 25 rest on the face 26A of a protecting skirt 26 attached to the lower part of holder 15. Said skirt 26 protects fibers $F_2$ and $F_3$ against any external shock. It may be made of moulded plastic material or of a metallic material and is provided with two openings through which fibers $F_2$ and $F_3$ extend.

The fibers are connected to a connector C, the opposite end of which is lit by a single light source 27 located within base 11. This light source may comprise a lamp supplied with a low voltage, for example, 6 volts. A filter can be placed between the lamp and the connector end, depending on the desired colour of centering marks $R_1$ and $R_2$ and $R_3$.

These marks are disposed on a line D which is substantially perpendicular to the geometrical axis 36 of block 10, mark $R_1$ being located on said axis 36 and marks $R_2$ and $R_3$ being very close to the lens supporting o-ring 16.

The operation of the device according to the invention is particularly simple and rapid.

A mounting block 10 is placed on holder 13A. Lens V is placed on the o-ring 16. The marks $R_1$, $R_2$ and $R_3$ are displaced by the lens while yet remaining in contact with its convex surface. The lens is centered with respect to the marks in such a way that $R_2$ and $R_3$ are located on the lines 28 marked on the convex surface of the lens and the centre of the cross 29, also marked on the convex surface, registers with $R_1$. The lens is maintained on its holder, then a pressure is applied on the latter so as to move it into its blocking position to attach the block to the convex surface of the lens.

As marks $R_1$, $R_2$ and $R_3$ are in contact with lines 28 and cross 29 marked on the convex surface of the lens, no parallax error can occur during the centering operation and this block 10 will be accurately positioned on the lens.

Naturally the device according to the invention is not limited to the embodiment selected and described.

Indeed, in the above embodiment the mounting block can only be fixed on the convex surface of a lens. It will be well understood that it is possible, simply by modifying the shape of the lens holder 15, to attach a block on the concave surface of a lens while maintaining one of the novel essential features of the device, viz. The continuous contact of the centering marks with the lens surface which is to receive the mounting block.

What is claimed is:

1. A device for attaching, on a spectacle lens, a block for mounting on a lens edging or bevelling machine, comprising: fixed mounting block holding means; lens holding means located substantially in one plane perpendicular to the axis of said block and lens holding means and movable between a centering position, in which the lens to be blocked is at a distance from the mounting block, and a blocking position for securing the mounting block on the lens; centering marks located substantially in said plane; said centering marks comprising luminous ends of optical fibers made of glass or plastic material, the end of each fiber being mounted in centering mark holding means, said centering mark holding means each comprising a holder for the end of each fiber and being movable in a direction substantially perpendicular to said plane in such a way that said centering marks are always in contact with the surface of a lens placed on said lens holding means, said surface being the surface adapted to subsequently receive the mounting block when in the blocking position; said lens holding means and centering mark holding means each being normally biased in said centering position.

2. A device according to claim 1, comprising three optical fibers, the ends of which are located on a straight line defined in said plane.

3. A device according to claim 2, wherein the end of one of the fibers intermediate the other fibers, is located on and movable along the geometrical axis of the mounting block.

4. A device according to claim 3, wherein the other two fibers are located on respective sides of the central fiber and at equal distances therefrom, the end of each of the two fibers being close to the lens holding means.

5. A device according to claim 1, wherein the fibers are lit by a single light source.

* * * * *